US005638452A

United States Patent [19]

Waller, Jr.

[11] Patent Number: 5,638,452

[45] Date of Patent: Jun. 10, 1997

[54] EXPANDABLE MULTI-DIMENSIONAL SOUND CIRCUIT

[75] Inventor: James K. Waller, Jr., Lake Orion, Mich.

[73] Assignee: Rocktron Corporation, Rochester Hills, Mich.

[21] Appl. No.: 426,055

[22] Filed: Apr. 21, 1995

[51] Int. Cl.[6] ..... H04R 5/00

[52] U.S. Cl. ..... 381/22

[58] Field of Search ..... 381/18, 19, 20, 381/21, 22, 23, 1, 2

[56] References Cited

U.S. PATENT DOCUMENTS

| | | | |
|---|---|---|---|
| 4,905,283 | 2/1990 | Ishikawa | 381/22 |
| 4,953,213 | 8/1990 | Tasaki et al. | 381/22 |
| 5,077,797 | 12/1991 | Ishikawa | 381/22 |
| 5,199,075 | 3/1993 | Fosgate | 381/22 |
| 5,319,713 | 6/1994 | Waller, Jr. et al. | 381/22 |

*Primary Examiner*—Curtis Kuntz
*Assistant Examiner*—Vivian Chang
*Attorney, Agent, or Firm*—Frank J. Catalano; Scott R. Zingerman

[57] ABSTRACT

An expandable multi-dimensional sound system has two modes of operation. Prior to the detection of a 20 kHz tone, the system is configured such that input audio panned hard to the left or right will result in the center and surround channels steering down so that the signal is only passed through the left front and right front channels, respectively. Mono information is fed only through the center channel, as the left and right front channels cancel any center channel or mono information. Material panned hard to the surround position steers down the front left and right channels and is only fed to the rear surround channels. No information is fed to the front center channel due to the fact that the signal contains only difference information. Directional steering to the rear channels is still provided in the absence of any hard broadband left or right panning. Upon the detection of a 20 kHz tone, the system is re-configured such that the left and right front channels and the center channel become disabled. The overhead channel becomes enabled, and the surround channels are not attenuated under hard broadband left or right panning conditions. Center information is fed through the overhead channel, while hard left information appears at the left rear channel and hard right information appears at the right rear channel. Upon the detection of a second 20 kHz tone, the system reverts back to its original operating configuration.

2 Claims, 8 Drawing Sheets

Left Steering Circuit
Right Steering Circuit
Center Steering Circuit
Overhead Steering Circuit
Surround Steering Circuit
Steering Voltage Generator
Tone Detect
Logic
L
R
L+R
L-R
L/R_V
R_RHV
L_RHV
R_RLV
L_RLV
L_O
C_O
OH_O
R_O
L_RO
R_RO
9L
9R
10L
10R
20
30
40
51
60
71
80
120
125
130
149L
149R
150
156
160
170

80
$R_{RHV}$
$L_{RHV}$
$R_{RLV}$
$L_{RLV}$
$L/R_V$
$F_V$
$B_V$
Time Constant Generator
Detector
-V
L
R
L+R
L-R

EXPANDABLE MULTI-DIMENSIONAL SOUND CIRCUIT

BACKGROUND OF THE INVENTION:

The present invention relates generally to audio sound systems and more particularly concerns audio sound systems which can decode from two-channel stereo into multi-channel sound, commonly referred to as "surround" sound.

Typical prior art surround systems have utilized a variable matrix for decoding a given signal into multi-channel outputs. Such a system is disclosed in U.S. Pat. No. 4,799,260, assigned to Dolby Laboratories, as well as in U.S. Pat. No. 5,172,415 to Fosgate. Each of these patents discloses a variable output matrix which provides the final outputs for the system. Other designs, such as that shown in U.S. Pat. No. 4,589,129 to David Blackmet, disclose a system which does not include a variable output matrix but instead includes individual steering blocks for left, center, right and surround.

The inventions described in my U.S. Pat. Nos. 5,319,713 and No. 5,333,201 are major improvements over what has become commercially known and available as Dolby Surround™ and Dolby Pro Logic™, primarily in that those patents describe a means for providing directional information to the rear channels, a feature which the Dolby systems do not provide. This feature is very desirable in exclusive audio applications, as well as in applications where audio is synched to video (A/V), and is fully described in the above-cited patents.

The evolution of the surround sound system has seen the developers of such systems progressively attempt to develop the technology which would allow audio engineers the ability to place specific sounds at any desired location in the 360° soundfield surrounding the listener. A recent result of this can be seen with the development of Dolby Laboratories' AC3 system, which provides five discreet channels of audio. However, there are at least two major drawbacks to such a system: (1) it is not backward-compatible with all existing material, and, (2) it requires digital data storage—not allowing for analog recording of data (i.e. audio tape, video tape, etc.). A Dolby AC3-encoded digital soundtrack cannot be played back through a Dolby Pro Logic system. It is desirable, therefore, to matrix an encoded recording down to a two-channel stereo recording and then have the ability to place specific sounds at any one of 6 or more predetermined locations as an individual, independent sound source when decoded. A six channel implementation of such a system might provide left front, right front, center, left rear, right rear and overhead locations. There are numerous other embodiments of the invention with many other possible channel configurations, as will be apparent to those skilled in the art.

In light of the prior art, it is a primary object of the present invention to provide a system which would decode a stereo signal into as many stand-alone, independent channels as desired. It is also an object of the present invention to provide a system which is compatible with all existing stereo material. It is another object of the present invention to provide a system which is compatible with material encoded for use with other existing suround systems. It is a further object of the present invention to provide a system that employs specifically encoded material which can be played back through any other existing decoding systems without producing undesirable results.

SUMMARY OF THE INVENTION:

In accordance with the invention, an expandable multi-dimensional sound system provides two modes of operation.

In the first mode, prior to the detection of a 20 kHz tone, the system is configured such that input audio panned hard to the left will result in the center and surround channels steering down so that the signal is only passed through the left front channel. Likewise, material panned hard right will result in the center and surround channels steering down and the signal being fed only through the right front channel. Mono information is fed only through the center channel, as the left and right front channels cancel any center channel or mono information and only difference information is fed to the rear surround channels. Material panned hard to the surround position steers down the front left and right channels and is only fed to the rear surround channels. No information is fed to the front center channel due to the fact that the signal contains only difference information. Directional steering to the rear channels is still provided in the absence of any hard broadband left or right panning.

Upon the detection of a 20 kHz tone, the system is re-configured to the second mode and operates such that the left and right front channels become disabled, as well as the center channel. The overhead channel becomes enabled, and the surround channels are not attenuated under hard broadband left or right panning conditions. In this configuration, center information is fed through the overhead channel, while hard left information appears at the left rear channel and hard right information appears at the right rear channel.

Upon the detection of a second 20 kHz tone, the system will revert back to its original operating configuration or first mode. With carefully encoded material, it is possible to provide very smooth operation with continous panning between all of the channels.

Material encoded with the system can be decoded through a typical surround decoder. However, material encoded for the overhead position will appear in the front center channel and material panned hard to the left or right rear channels will appear in the front left and right channels, as such other systems do not provide the enhancement for individual separation of sounds to all of six channels.

The system can also be expanded to accommodate a greater number of channels with the addition of more tone detection circuits. For example, the system could be configured such that the left and right rear channels could be switched to alternate channels, such as left and right side channels, when a specified tone is detected, thereby producing an eight channel system.

The system disclosed would take advantage of all of the further improvements as demonstrated in my U.S. Pat. No. 5,333,201.

The present invention also lends itself to implementation as a DSP software algorithm. In a DSP implementation, it would be conceivable to divide the audio spectrum into a larger number of frequency bands to get even better frequency resolution, thereby providing better localization at specific frequency bands within the audio spectrum.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
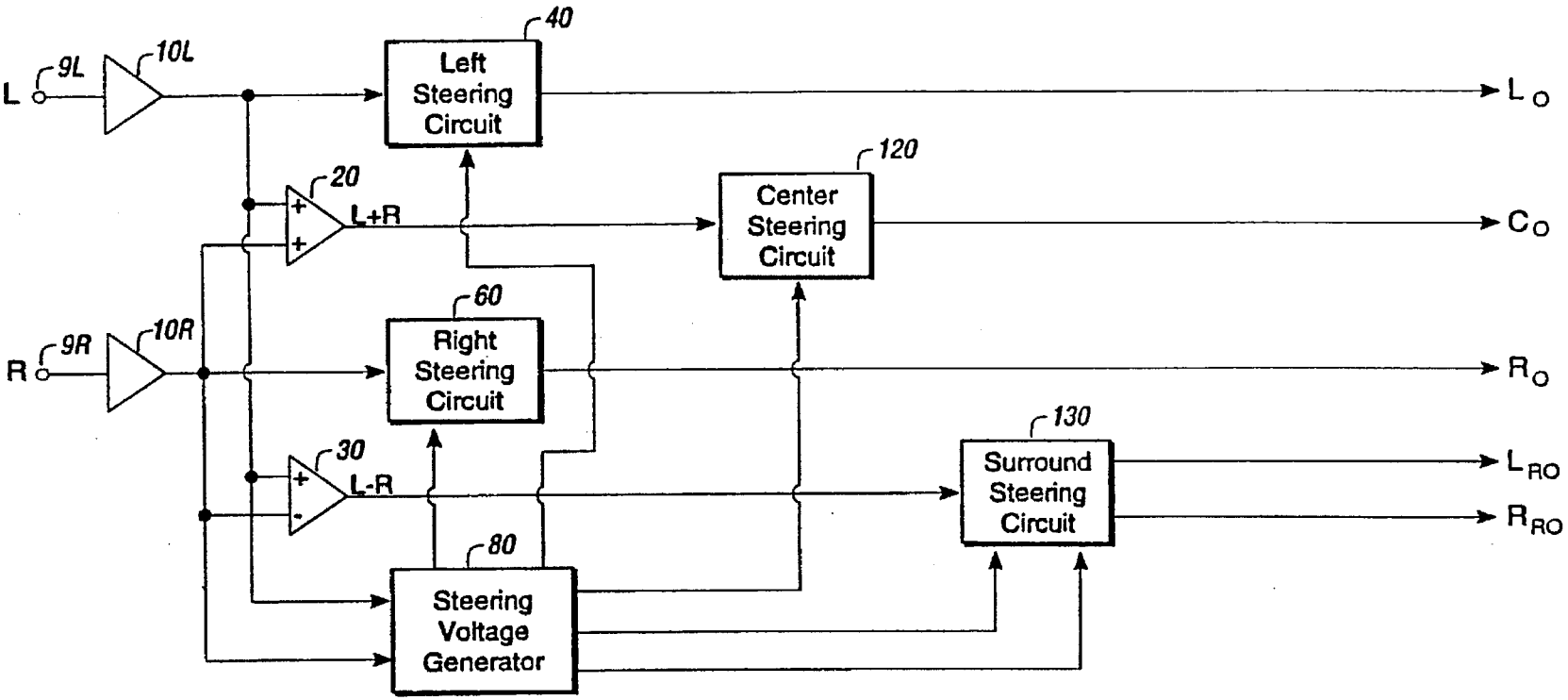
FIG. 1 (Prior Art)
FIG. 1 is a block diagram of a prior art surround system incorporating the improvements disclosed in my U.S. Pat. Nos. 5,319,713 and No. 5,333,201.

Referring to FIG. 1, a fully implemented prior art surround system, based on the improvements disclosed in my U.S. Pat. Nos. 5,319,713 and 5,333,201, is shown in which a left input signal L is applied to an input node 9L. This input signal L is buffered by an amplifier 10L and fed to a Left Steering Circuit 40, as well as to a summing amplifier 20, a difference amplifier 30 and a Steering Voltage Generator 80. A right input signal R is also fed to an input node 9R, buffered by an amplifier 1 OR and fed to a Right Steering Circuit 60, the summing amplifier 20, the difference amplifier 30 and the Steering Voltage Generator 80. The signal output L+R from the summing amplifier 20 is fed to a Center Steering Circuit 120, which then provides the center channel output $C_o$, while the signal output L−R from the difference amplifier 30 is fed to a Surround Steering Circuit 130 which then provides the left and right rear outputs $L_R$ and $R_R$. Each of the steering circuits 40, 60, 120 and 130 are controlled by the Steering Voltage Generator 80.

In the systems disclosed in my U.S. Pat. Nos. 5,319,713 and 5,333,201, information panned hard to the left or right is emphasized in the respective rear channel to enhance the left and right imaging in the surround channels. Such a system could be re-configured so that information panned hard to the left or right broadband is attenuated in the rear channels rather than emphasized. For the purpose of the present disclosure, "broadband" panning is defined as recording a signal such that the entire audio spectrum is fed to either the left or right channel for playback at the input of the disclosed invention, where no fragment of the input signal appears at the opposite channel. Modifications to this system such that hard left or hard right broadband panned information could be attenuated in the rear channel will be hereinafter described in relation to FIG. 6. It should be noted at this juncture that the prior art system shown in FIG. 1 can be re-configured so that input audio panned hard to the left will result in the center and surround channels $C_O$, $L_{RO}$ and $R_{RO}$ steering down, so that the signal is only passed through the left front channel $L_O$. Likewise, material panned hard right will result in the center and surround channels $C_O$, $L_{RO}$ and $R_{RO}$ steering down and the signal being fed only through the right front channel $R_O$. Material panned hard to the surround position steers down the front left and right channels $L_O$ and $R_O$ and is only fed to the rear surround channels $L_{RO}$ and $R_{RO}$. No information is fed to the front center channel $C_O$ due to the fact that the signal contains only difference (equal amplitude audio 180° out of phase in left and right channels) information.

Figure 2:
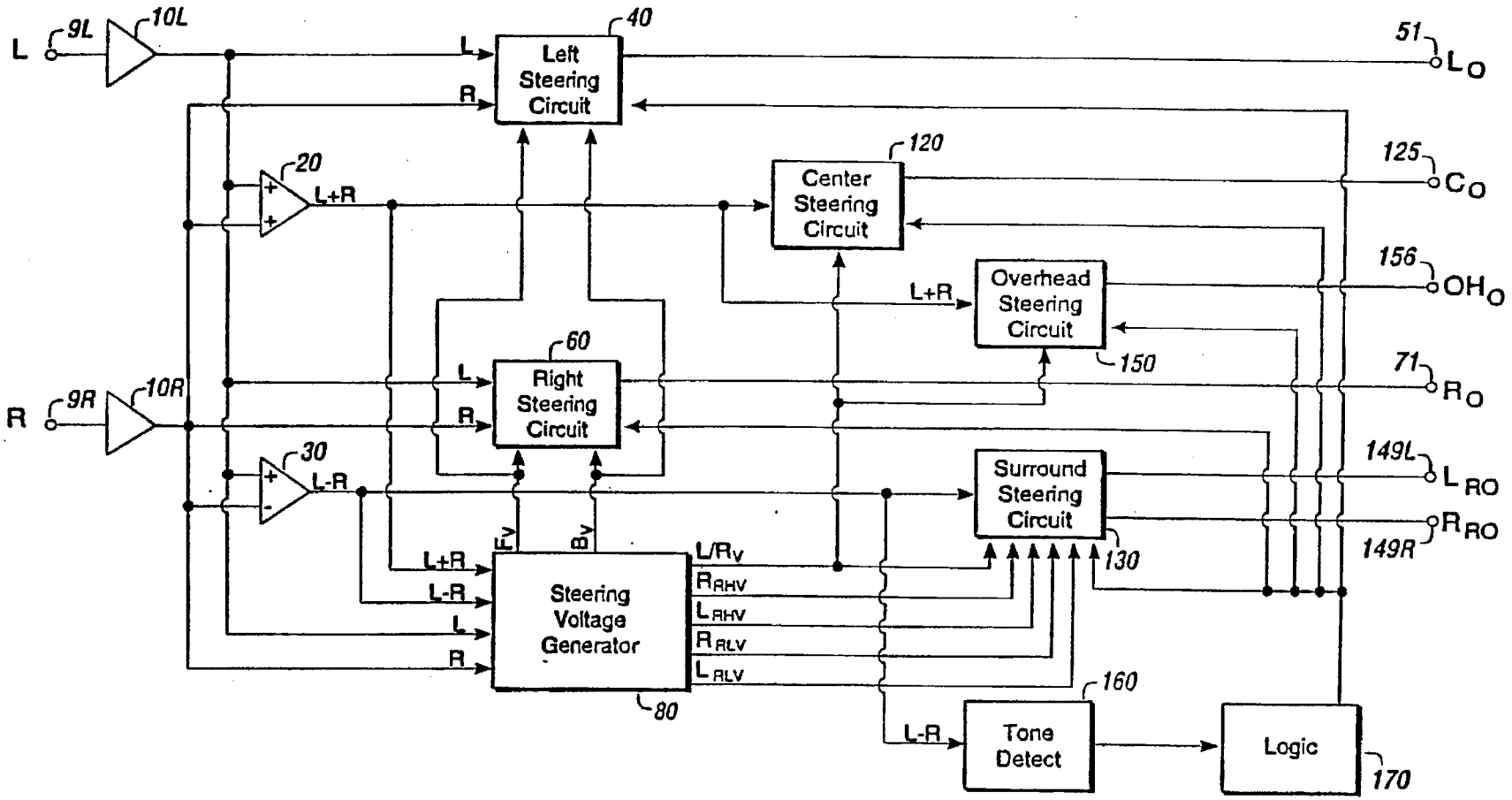
FIG. 2 is a block diagram of a simplistic implementation of the present invention.

There are many potential embodiments of the present invention. However, for illustrative purposes, a six-channel implementation is shown in FIG. 2. Left and right input signals L and R are applied to input nodes 9L and 9R, respectively, which are each buffered by amplifier 10L and 10R, respectively, and fed to the Steering Voltage Generator 80, as well as to the Left Steering Circuit 40 and the Right Steering Circuit 60 which provide the left and right outputs $L_O$ and $R_O$, respectively. The Left Steering Circuit 40 and the Right Steering Circuit 60 are each controlled by the Steering Voltage Generator 80, as well as by a Logic Circuit 170. The buffered input signals L and R are summed at the summing amplifier 20, where the summed input signal L+R is then fed to the Center Steering Circuit 120, which provides the center channel output $C_O$. The Center Steering Circuit 120 is also controlled by the Steering Voltage Generator 80, as well as by the Logic Circuit 170. The output L+R of the summing amplifier 20 is also fed to an Overhead Steering Circuit 150, which then provides the overhead output $OH_O$. The Overhead Steering Circuit 150 is controlled by the Steering Voltage Generator 80, as well as by the Logic Circuit 170. The buffered input signals L and R are also fed to the difference amplifier 30, and the difference signal L−R is then fed to the Surround Steering Circuit 130 which provides the left and right rear outputs $L_{RO}$ and $R_{RO}$, respectively. The Surround Steering Circuit 130 is controlled by the Steering Voltage Generator 80, as well as by the Logic Circuit 170. The output signal L−R of the difference amplifier 30 is also fed to a Tone Detect Circuit 160 which then feeds the Logic Circuit 170.

A short tone (on the order of 10 ms) can be buried in the audio during the recording process at a specific frequency at the very upper edge of the audio spectrum (i.e. 20 kHz). A frequency of 20 kHz is still within the recordable bandwidth for hi-fi VCR and Compact Discs. Upon detecting this short tone burst, the Tone Detect Circuit 160 triggers the Logic Circuit 170. the Logic Circuit 170 then configures the on/off status of each VCA contained within the Left Steering Circuit 40, the Right Steering Circuit 60, the Center Steering Circuit 120, the Overhead Steering Circuit 150 and the Surround Steering Circuit 130. Any change in the on/off status of a particular channel occurs over a specified amount of time to guarantee a smooth transition from one channel to the next. Configuring the system in this manner allows the surround circuit to have two independent modes of operation: a normal left, center, right, left rear and right rear surround mode as described in relation to FIG. 1, and a re-configured surround mode when the predetermined buried tone is detected, causing the Logic Circuit 170 to change the status of the specified steering circuits. Using the six channel configuration shown in FIG. 2, a buried tone detected by the Tone Detect Circuit 160 would result in the Logic circuit 170 disabling the left, center and right front channels $L_O$, $C_O$ and $R_O$, while simultaneously enabling the overhead channel $OH_O$ and changing the response characteristics of the left and right rear channels $L_{RO}$ and $R_{RO}$ such that material panned hard left or right will not cause the respective rear channel $L_{RO}$ and $R_{RO}$ to steer down. In this configuration, any summed signal L+R is now fed through the overhead channel $OH_O$ instead of the center channel $C_O$, and signals panned hard left or right are fed through the respective left or right rear channel $L_{RO}$ or $R_{RO}$. Should the Tone Detect Circuit 160 detect the specified buried signal a second time, the Logic Circuit 170 would reset the surround system back to its original operating configuration. Additional Tone Detect Circuits can be added to provide additional system configurations when embedded tones at different specified frequencies are detected, thereby increasing the potential number of channels.

More elaborate schemes can be implemented for detecting the buried tones which determine the configuration of the steering circuits which would reduce the potential for falsing (such as embeding a series of tones at different frequencies instead of a single tone). It will be apparent to anyone skilled in the art that there are many more possible embodiments of the invention with more elaborate detecting schemes which could be implemented.

Figure 3:
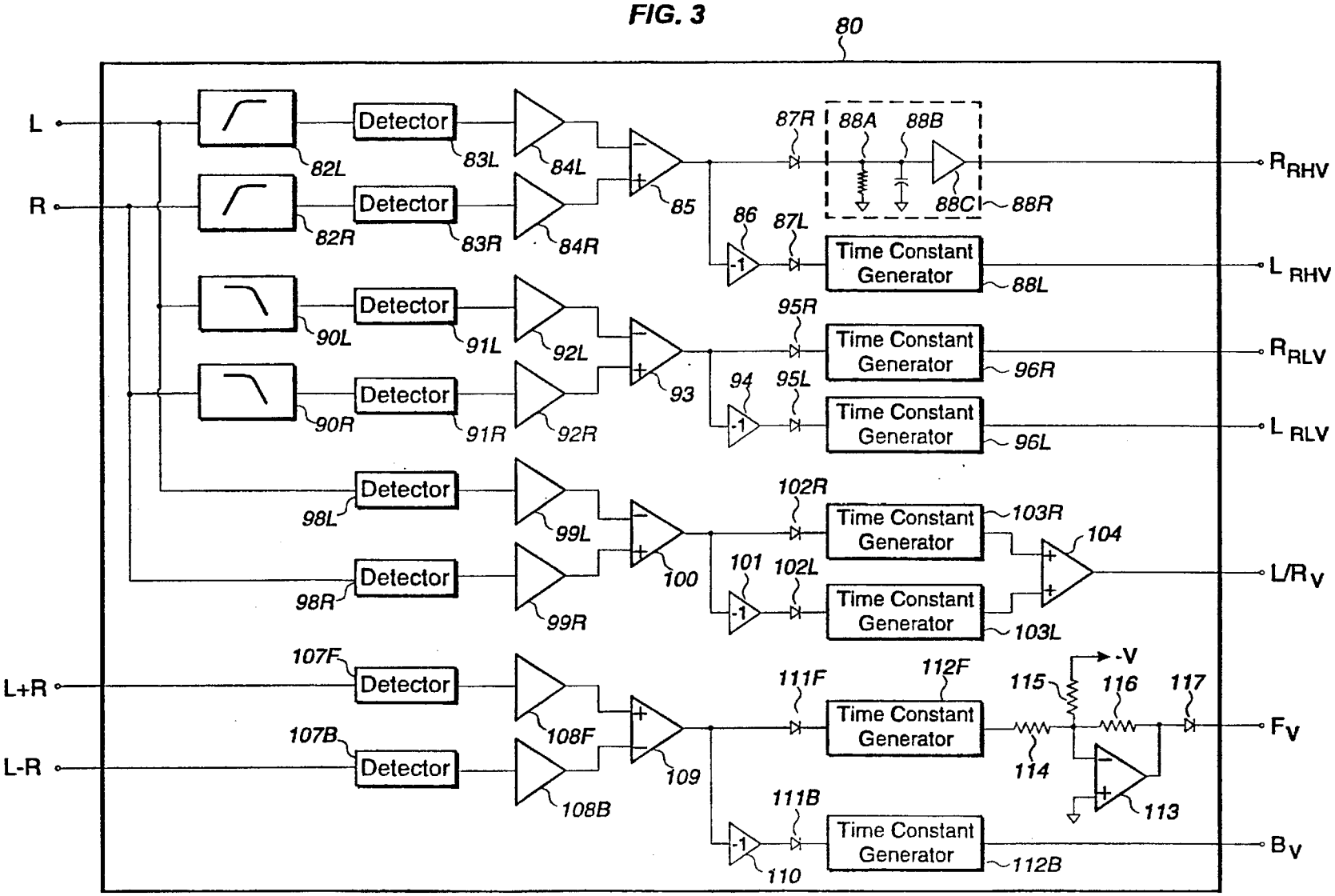
FIG. 3 is a partial block/partial schematic diagram of the Steering Voltage Generator of FIG. 2.

Referring to FIG. 3, the Steering Voltage Generator 80 accepts left and right input signals L and R, respectively, which are fed through high pass filters 82L and 82R, respectively. These filters are shown and described as 101 and 103 in FIG. 4 of my U.S. Pat. No. 5,319,713. The filtered signals are then fed to level detectors 83L and 83R, which are the equivalent of those provided by the RSP 2060 IC. All detectors shown in FIG. 3 are equivalent to those provided by the RSP 2060 IC, although other forms of level detection can be implemented, such as peak averaging, RMS detection, etc. The detected signals are buffered through buffer amplifiers 84L and 84R before being applied to a difference amplifier 85. Predominant right high band information detected will result in a positive-going output from difference amplifier 85. This positive-going output is fed to a diode 87R, followed by a Time Constant Generator 88R. A positive voltage applied to the Time Constant Generator 88R will produce a positive voltage that is stored by a capacitor 88B. Therefore, the attack time constant is extremely fast, as a positive voltage applied from the output of the difference amplifier 85 will produce an instantaneous charge current for the capacitor 88B. The release characteristics of the Time Constant Generator 88R are produced by the capacitor 88B and a resistor 88A. The resistor 88A will be the only discharge path for the capacitor 88B. The voltage on the capacitor 88B is buffered by an amplifier 88C, which then provides a Right Rear High band Voltage output signal $R_{RHV}$ fed to the Surround Steering Circuit 130. All the other Time Constant Generators 88L, 90R, 96L, 103R, 103L, 112F and 112B shown in FIG. 3 operate identically to the Time Constant Generator 88R.

Conversely, predominant left high band information will result in a negative-going output from the difference amplifier 85. This negative-going output is inverted by an inverting amplifier 86, producing a positive-going output through a diode 87L and the Time Constant Generator 88L to provide the Left Rear High band Voltage output signal $L_{RHV}$ fed to the Surround Steering Circuit 130.

The input signals L and R applied to the Steering Voltage Generator 80 are also fed through low pass filters 90L and 90R, respectively, before level detection is derived by detectors 91L and 91R. The detected signals are buffered through operational amplifiers 92L and 92R before being applied to a difference amplifier 93. Predominant right low band information detected will result in a positive-going output from the difference amplifier 93. This positive-going output is then fed to a diode 95R, followed by the Time Constant Generator 96R to provide the Right Rear Low band Voltage output signal $R_{RLV}$ fed to the Surround Steering Circuit 130. Conversely, predominant left low band information will result in a negative-going output from the difference amplifier 93. This negative-going output is inverted by an inverting amplifier 94, producing a positive-going output through a diode 95L and the Time Constant Generator 96L to provide the Left Rear Low band Voltage output signal $L_{RLV}$ fed to the Surround Steering Circuit 130.

In addition, the L and R input signals applied to the Steering Voltage Generator 80 are broadband level detected through detectors 98L and 98R, respectively. The detected signals are then buffered through operational amplifiers 99L and 99R before being applied to a difference amplifier 100. Predominant left information detected will cause the difference amplifier 100 to provide a negative-going signal which is fed to an inverting amplifier 101. The positive output from the inverting amplifier 101 is fed through a diode 102L to the Time Constant Generator 103L, which produces a positive-going voltage at the output of the Time Constant Generator 103L. Conversely, if predominant right information is detected, the output of the difference amplifier 100 provides a positive-going signal which feeds a diode 102R and the Time Constant Generator 103R. The outputs of both the Time Constant Generators 103L and 103R are fed to a summing amplifier 104 so that an output voltage $L/R_V$ will be derived from either a predominant left or right signal. This output voltage $L/R_V$ is then fed to the Surround Steering Circuit 130, the Center Steering Circuit 120, and the Overhead Steering Circuit 150.

The Steering Voltage Generator 80 also accepts the summed input signal L+R as well as the difference input signal L–R. These input signals are level detected through detectors 107F and 107B, respectively, and buffered through amplifiers 108F and 108B. The buffered signals are then applied to a difference amplifier 109. Predominant summed L+R information detected will produce a positive-going voltage at the output of the difference amplifier 109 and the Time Constant Generator 112F. An operational amplifier 113 inverts this signal to a negative-going voltage which is then used to control the steering VCAs in the Left Steering Circuit 40 and the Right Steering Circuit 60. This operational amplifier 113 is configured as a unity gain inverting amplifier which has an additional resistor 115 applied between its "–" input and a negative supply voltage –V to provide a positive offset voltage at the output of the operational amplifier 113. In a quiescent condition, in which no front summed L+R or difference L–R information is present, the operational amplifier 113 will always provide a specified positive offset voltage so that, when applied to the Left Steering Circuit 40 and the Right Steering Circuit 60, it provides the proper voltage to attenuate the steering VCAs in those circuits. Therefore, a positive voltage is always applied at an output $F_V$ unless front information is detected. When front L+R information is detected, the output of the operational amplifier 113 will begin going negative from the positive offset voltage that was present prior to detecting the presence of front L+R information. A strong presence of L+R information will cause the output of the operational amplifier 113 to go negative enough to cross 0 volts. When the output of the operational amplifier 113 crosses 0 volts, a diode 117 becomes reverse biased and provides zero output voltage at the output $F_V$.

Predominant surround L–R information detected will produce a negative-going voltage at the output of the difference amplifier 109. This negative-going voltage is inverted by an inverting amplifier 110 and therefore produces a positive output from the Time Constant Generator 112B to provide an output $B_V$ which controls steering VCAs in the Left Steering Circuit 40 and the Right Steering Circuit 60.

Figure 4L:
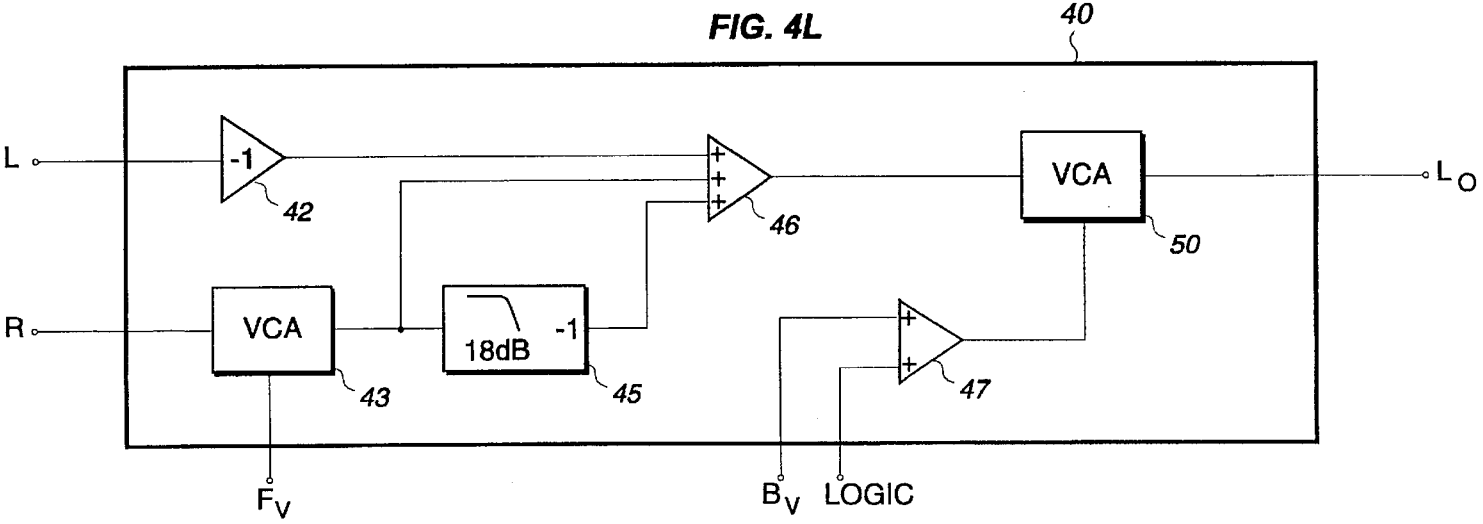
FIG. 4L is a partial block/partial schematic diagram of the Left Steering Circuit of FIG. 2.

Referring to FIG. 4L, the input signals L and R are applied to the Left Steering Circuit 40. The input signal L is inverted through an amplifier 42 and fed to a summing network 46. The input signal R is fed through a VCA 43 before being fed to the summing network 46 VCAs are commonly known and used in the art, and any skilled artisan will understand how to implement a Voltage Controlled Amplifier which will provide the proper functions for all of the Voltage Controlled Amplifiers demonstrated in the present invention. The VCA 43 is controlled by the signal $F_V$ applied at its control port. The output of the VCA 43 is fed to the input of an 18 dB/octave inverting low pass filter 45. Anyone skilled in the art will understand how to design and implement such a filter network. The output of the filter 45 is also fed to summing network 46. When the output of filter 45 is summed with the output of VCA 43, all of the low band information below the corner frequency of filter 45 is subtracted. In practice, this corner frequency is typically 200 Hz. When the outputs of the inverting amplifier 42, the VCA 43 and the low pass filter 45 are summed at the summing network 46, the output of the summing network 46 will contain the difference between the left and right inputs L and R. However, the low band information below the corner frequency of the low pass filter 45 is not affected, and therefore appears at the output of the summing network 46. This process allows for the removal of center channel information from the left output $L_O$ signal. As the signal applied to the control port $F_V$ of the VCA 43 goes positive, the output of the VCA 43 attenuates and less cancellation of the center signal L+R occurs. Therefore, it can be seen that, in a quiescent condition, the signal $F_V$ applied at the control port of the VCA 43 is positive and no attenuation takes place. As center channel information L+R is detected by the Steering Voltage Generator 80, the signal $F_V$ will go negative, eventually reaching 0 volts, and will result in the total removal of the center channel signal from the left output $L_O$.

The output of the summing amplifier 46 is then fed to another VCA 50 which provides the left output signal $L_O$. The VCA 50 is controlled by a summing amplifier 47 which provides a positive-going voltage determined by either a signal $B_V$ or a Logic signal applied at its inputs. Surround information L–R detected in the input signals L and R will produce a positive-going voltage $B_V$ at the input to the summing amplifier 47 which will produce attenuation in the VCA 50. This allows strong surround information L–R to be attenuated in the left front output signal $L_O$ such that a hard surround signal applied during the encoding process is totally eliminated in the left front $L_O$ and will only appear at the respective rear surround channel $R_{RO}$. Attenuation of the VCA 50 is also provided when a positive logic signal is applied to the input of the summing amplifier 47.

Figure 4R:
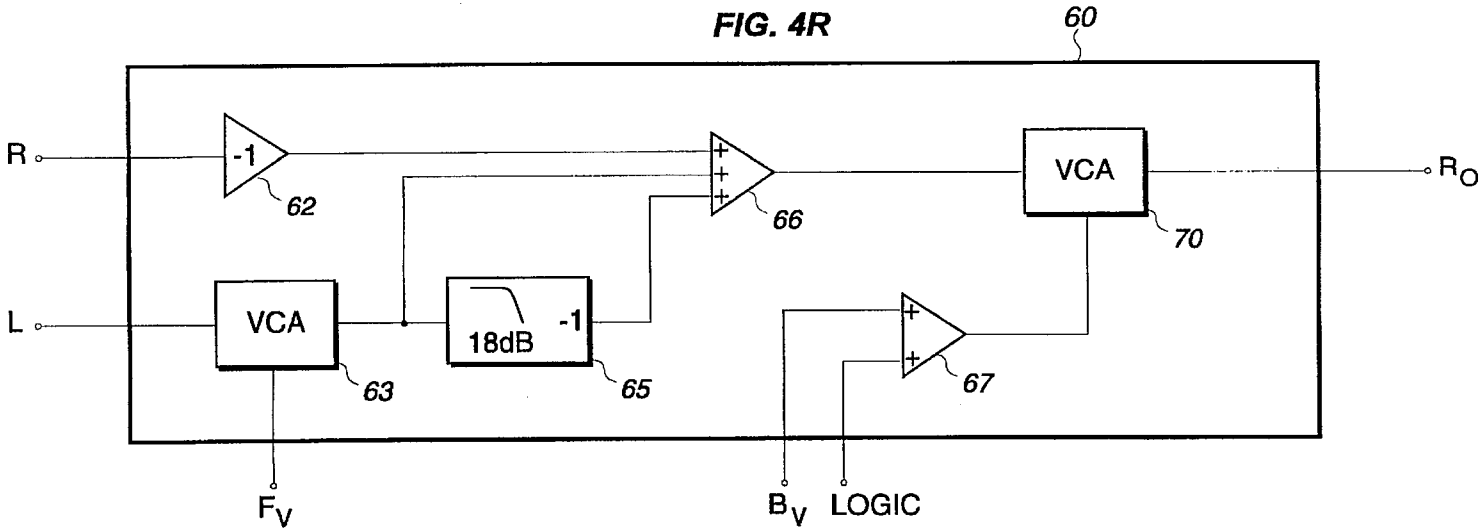
FIG. 4R is a partial block/partial schematic diagram of the Right Steering Circuit of FIG. 2.

The Right Steering Circuit 60 is shown in FIG. 4R. The Right Steering Circuit 60 operates identically to the Left Steering Circuit 40 to provide the Right output signal $R_O$, with the exception that the input signals L and R are reversed.

Figure 5H:
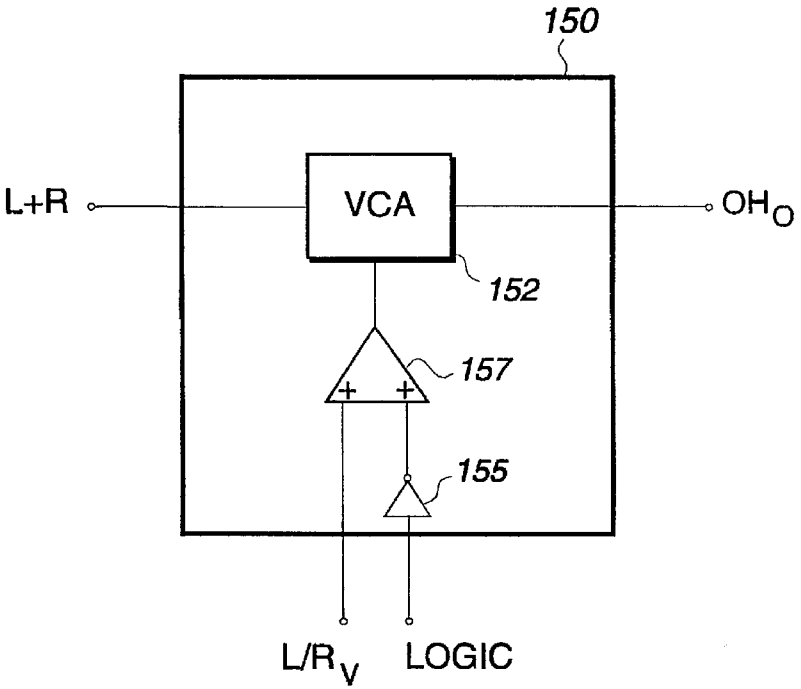
FIG. 5H is a partial block/partial schematic diagram of the Overhead Steering Circuit of FIG. 2.
Figure 5C:
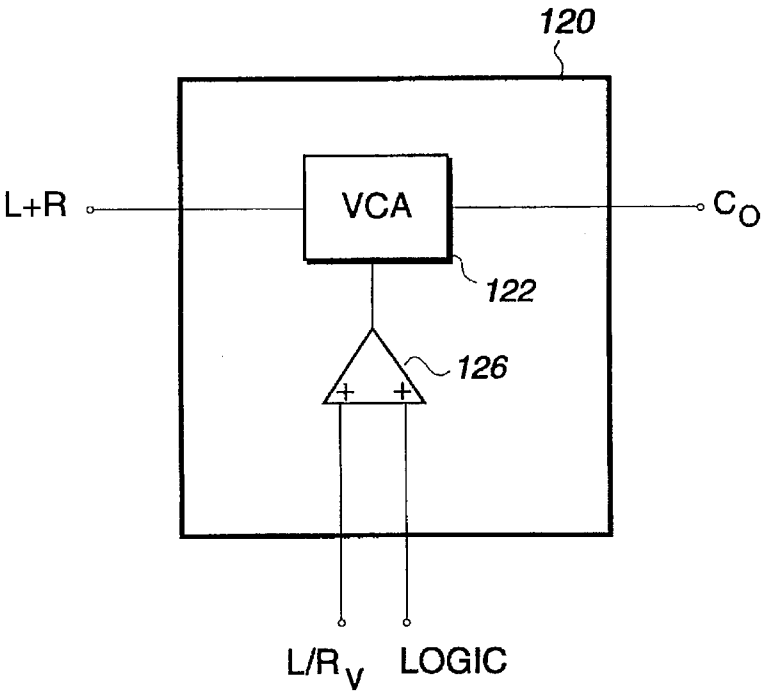
FIG. 5C is a partial block/partial schematic diagram of Center Steering Circuit of FIG. 2.

Referring to FIG. 5C, the summed signal L+R is input to the Center Steering Circuit 120. This input signal L+R is fed through a VCA 122 to provide the center channel output $C_O$ of the Center Steering Circuit 120. The VCA 122 is controlled by a summing amplifier 126, which accepts both the signal $L/R_V$ from the Steering Voltage Generator 80 and a Logic input. It becomes apparent that left or right broadband panning will cause the VCA 122 to attenuate the center output Co, as broadband left or right panning will produce a positive-going signal $L/R_V$ into the summing amplifier 126 and the control port of the VCA 122. A positive Logic signal applied will also produce a positive voltage at the output of the summing amplifier 126 to also provide attenuation of the output $C_O$ of the VCA 122.

The Overhead Steering Circuit 150 is shown in FIG. 5H. The Overhead Steering Circuit 150 operates identically to the Center Steering Circuit 120 to provide the Overhead output signal $OH_o$, with the exception that an inverter 155 is placed between the Logic input and the input to a control amplifier 157. The inverter 155 ensures that the Logic signal applied to disable the Center Steering Circuit 120 will simultaneously enable the Overhead Steering Circuit 150. Therefore, when hard left or right broadband panning is detected by the Steering Voltage Generator 80, the signal $L/R_V$ applied to the input of the summing amplifier 157 will cause the VCA 152 to attenuate the overhead output signal $OH_O$.

Figure 6:
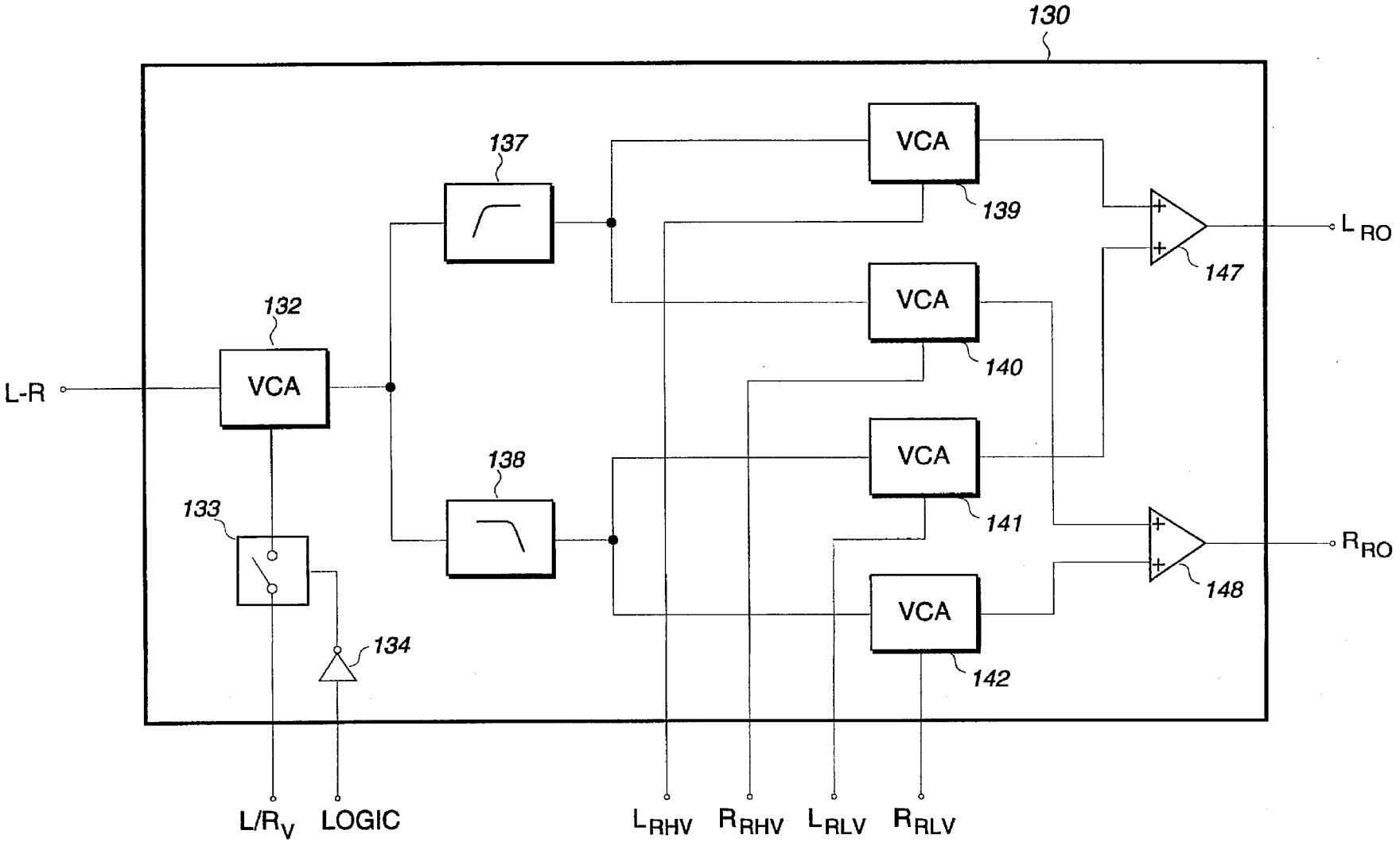
FIG. 6 is a partial block/partial schematic diagram of the Surround Steering Circuit of FIG. 2.

Referring to FIG. 6, the Surround Steering Circuit 130 accepts the differenced signal L–R at its input and applies it to the input of a VCA 132, which is controlled by the condition of an analog switch 133 in its control path. The status of the analog switch 133 is controlled by a Logic signal which is inverted by a logic the inverter 134. With a logic level 1 signal applied to the inverter 134 "set" position (high), a low output appears at the output of the inverter 134 which opens the analog switch 133 and does not allow for any attenuation of the rear channel signals $L_{RO}$ and $R_{RO}$ based on the signal $L/R_V$ applied to the input of the analog switch 133. Logic will be applied in a "set" position the first time a specified tone is detected. Conversely, a logic level 0 signal applied in the "reset" position (low) will cause a high output to appear at the output of the inverter 134 which closes the analog switch 133 and allows for the attenuation of the rear channel signals $L_{RO}$ and $R_{RO}$ based on the signal $L/R_V$ applied at the input of switch 133. Logic is applied in a "reset" condition when the system is powered up, as well as when a specified tone is detected a second time, to reset the system to its original operating configuration. The system is configured such that only extreme hard left or hard right broadband panning causes the VCA 132 to attenuate, so that full left/right directional information remains present under typical stereo conditions.

The output of the VCA 132 is applied to a high pass filter 137, which produces high band output to drive steering VCAs 139 and 140. The output of the VCA 132 is also applied to a low pass filter 138, which produces a low band output to drive steering VCAs 141 and 142. Filters 137 and 138 are clearly disclosed and described in my previously cited '713 patent as High Pass Filter 31 and Low Pass Filter 32. The high band output from the VCA 139 is summed with the low band output from the VCA 141 at a summing amplifier 147. The summation of these two signals provides the Left Rear Output signal $L_{RO}$ at the left mar channel. Similarly, the high band output from the VCA 140 is summed with the low band output from the VCA 142 to provide the Right Rear Output signal $R_{RO}$ fed to the right rear channel. The Steering voltages $L_{RHV}$, $R_{RHV}$, $L_{RLV}$ and $R_{RLV}$ applied to the control ports of the VCAs 139, 140, 141 and 142, respectively, control the left and right rear (surround) steering. The basic operation of multiband steering is described in my U.S. Pat. No. 5,319,713.

Figure 7:
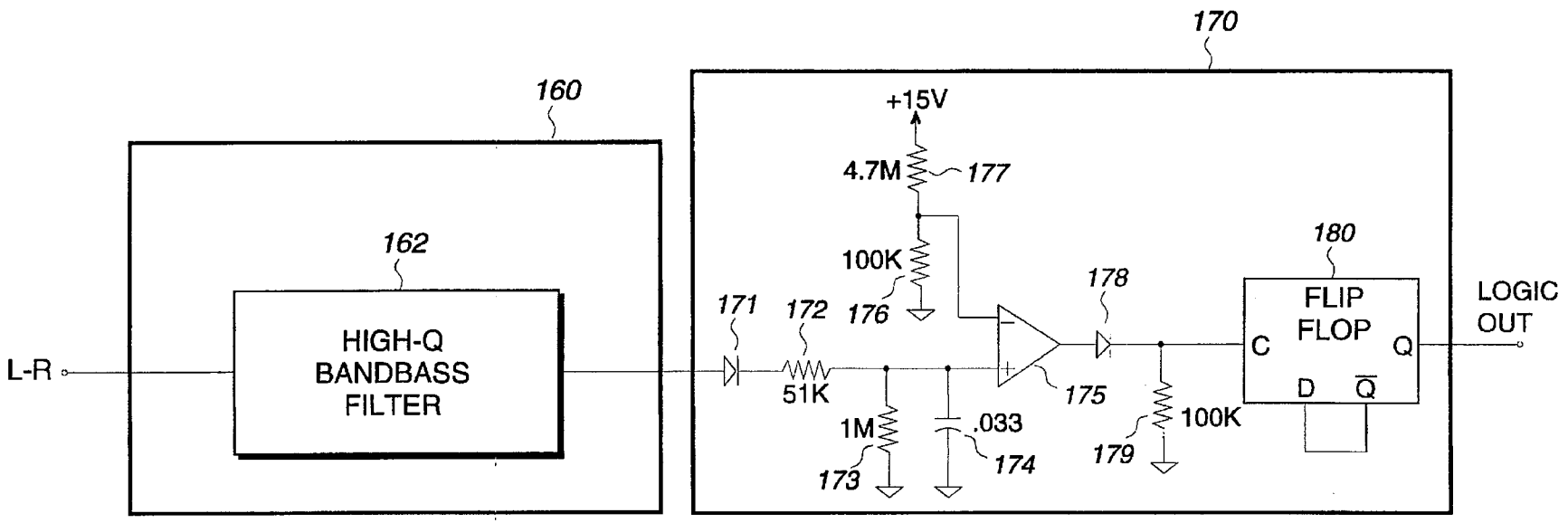
FIG. 7 is a partial block/partial schematic diagram of the Tone Detect Circuit and Logic Circuit of FIG. 2.
Figure 8:
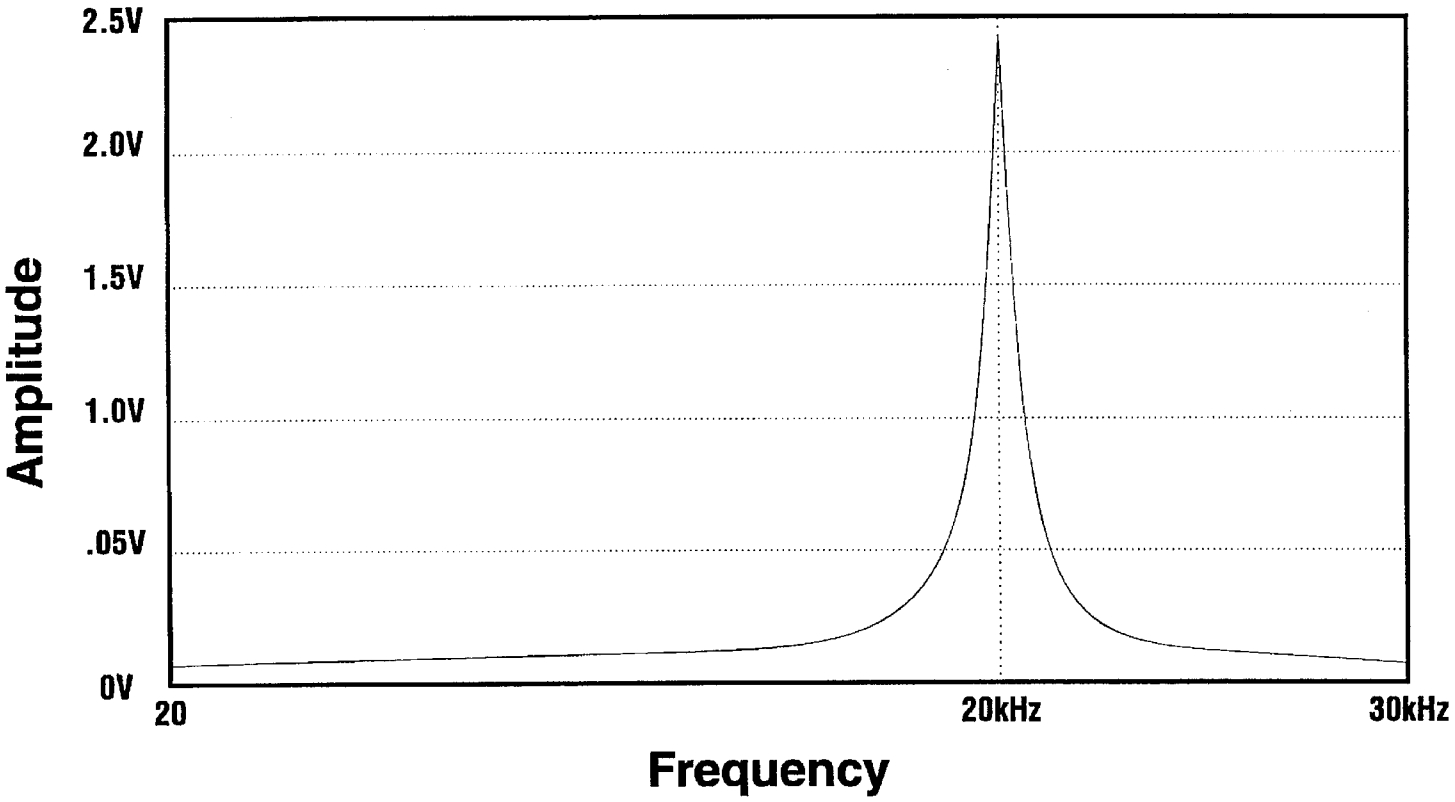
FIG. 8 is an amplitude vs. frequency graph representing the response of a high-Q bandpass filter incorporated in the Tone Detect Circuit.

Referring to FIG. 7, the difference signal L–R as shown in FIG. 2 is applied to the input of the Tone Detect circuit 160. In the preferred embodiment, the embedded tone is detected as an encoded differenced signal L–R. This is desirable due to the fact that the center channel $C_O$ is typically the predominant channel, especially in video applications. Therefore, difference L–R information will not be present in the center channel $C_O$. In other embodiments of the invention, the embedded tone could be encoded and then detected as either a summed signal L+R, a hard left signal or a hard right signal. In the decoding process, it is apparent to anyone skilled in the art to detect the appropriate signal L,R, L+R or L−R for detecting the embedded tone. The differential signal L−R is fed to a high-Q bandpass filter 162. The filter 162 is a two-pole, high-Q bandpass filter having a typical Q of approximately 40. Anyone skilled in the art will understand how to design a high-Q bandpass filter with the stated response characteristics. An amplitude vs. frequency plot of the response characteristics of high-Q bandpass the filter 162 is shown in FIG. 8. Referring back to FIG. 7, when a tone of 20 kHz is detected, the output of the filter 162 produces an output amplitude. This amplitude is then fed to the input to the Logic Circuit 170. When the amplitude input to the Logic Circuit 170 is above 0.3 V, a comparator 175 produces an output. The comparator 175 is configured so that, when a signal is detected from the output of the Tone Detect Circuit 160, the comparator 175 will go high. The "−" input of the amplifier 175 is configured with a voltage divider through resistors 176 and 177 which form a voltage divider producing a voltage of approximately 0.3 volts, which becomes the reference voltage for the "−" input of comparator 175. When a signal is detected at the output of the Tone Detect Circuit 160, it is forward conducted through a diode 171. A resistor 172 and capacitor 174 form a filter network, where the resistor 172 provides an attack time constant. A tone of proper amplitude for a proper duration is required to charge the capacitor 174 to a point where the comparator 175 will trip and produce a positive output. A resistor 173 provides a discharge path for the capacitor 174 and sets the release time constant for the comparator 175. The output of the comparator 175 feeds a diode 178, which will produce a positive output when the comparator 175 goes positive. A resistor 179 maintains a 0 volt bias at the input of a flip-flop circuit 180. The flip-flop 180 is a standard D-type flip-flop configured with its input Q tied to the data input D, its input signal applied to the clock input C and its output taken from the output Q. The flip flop circuit 180 produces an output logic "1" when a positive pulse is applied to its input. Therefore, when a tone is detected at the proper frequency, of the proper amplitude and for the proper duration, the flip-flop 180 will produce a positive voltage at its output Q. The logic level 1 output is then applied to the appropriate logic control lines for each of the steering circuits.

Thus it becomes apparent that the system provides two modes of operation where, prior to the detection of a 20 kHz tone, the system is configured such that input audio panned hard to the left will result in the center $C_O$ and surround $L_{RO}$ and $R_{RO}$ channels steering down so that the signal is only passed through the left front channel $L_O$. Likewise, material panned hard right will result in the center $C_O$ and surround channels $L_{RO}$ and $R_{RO}$ steering down and the signal being fed only through the right front channel $R_O$. Mono information L+R is fed only through the center channel $C_O$, as the left and right front channels $L_O$ and $R_O$ cancel any center channel or mono information L+R due to the operation of the Left and Right Steering Circuits 40 and 60, and only difference information L−R is fed to the rear surround channels $L_{RO}$ and $R_{RO}$. Material panned hard to the surround position steers down the front left and right channels $L_O$ and $R_O$ and is only fed to the rear surround channels $L_{RO}$ and $R_{RO}$. No information is fed to the front center channel $C_O$ due to the fact that the signal contains only difference information. Directional steering to the rear channels $L_{RO}$ and $R_O$ is still provided in the absence of any hard broadband left or right panning.

Upon the detection of a 20 kHz tone, the system is re-configured and operates such that the left and right front channels $L_O$ and $R_O$ become disabled, as well as the center channel $C_O$. The overhead channel $OH_O$ becomes enabled, and the surround channels $L_{RO}$ and $R_{RO}$ are not attenuated under hard broadband left or right panning conditions. In this configuration, center information L+R is fed through the overhead channel $OH_O$, while hard left information appears at the left rear channel $L_{RO}$ and hard right information appears at the right rear channel $R_{RO}$.

Upon the detection of a second 20 kHz tone, the system will revert back to its original operating configuration. With carefully encoded material, it is possible to provide very smooth operation with continous panning between all of the channels.

Material encoded with the system can be decoded through a typical surround decoder, such as Dolby Pro Logic. However, material encoded for the overhead position will appear in the front center channel and material panned hard to the left or right rear channels will appear in the front left and right channels, as such other systems do not provide the enhancement for individual separation of sounds to all of six channels.

The system can also be expanded to accommodate a greater number of channels with the addition of more Tone Detect circuits. For example, the system could be configured such that the left and right rear channels could be switched to alternate channels, such as left and right side channels, when a specified tone is detected, thereby producing an eight channel system.

The system disclosed would take advantage of all of the further improvements as demonstrated in my U.S. Pat. No. 5,333,201.

The present invention also lends itself to implementation as a DSP software algorithm. In a DSP implementation, it would be conceivable to divide the audio spectrum into a larger number of frequency bands to get even better frequency resolution, thereby providing better localization at specific frequency bands within the audio spectrum. The further enhancements that could be provided through a DSP implementation will become apparent to those skilled in the art, and are well withing the scope of the invention.

Thus, it is apparent that there has been provided, in accordance with the invention, an expandable multi dimensional sound circuit that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A circuit for decoding two input channel stereo signals into multi-channel sound signals comprising:

at least one means for combining the two channel stereo signals to provide at least a third input signal;

means for receiving the two input signals and said third input signal and for generating a plurality of steering voltages, each said steering voltage being indicative of a predominance of a respective one of said two input signals and third input signal in one of a plurality of frequency bands;

a plurality of steering means, each for receiving at least one of the two input signals and said third input signal and for providing an output signal derived from its respective at least one of the two input signals and said third input signal attenuated by at least one of said steering voltages; and at least one means for detecting a signal representative of a tone embedded in said third input signal and for reconfiguring said plurality of steering means in response to detection of said embedded tone signal.

2. A circuit for decoding two channel stereo signals into multi-channel sound signals comprising:

means for summing the two channel stereo signals to provide a third signal;

means for differencing the two channel stereo signals to provide a fourth signal;

means for receiving said four signals and for generating a plurality of steering voltages, each said steering voltage being indicative of a predominance of a respective one of said four signals in one of a plurality of frequency bands;

at least one means for receiving said fourth signal and for detecting a signal representative of a tone embedded in at least one of said four signals;

at least one means responsive to said at least one detecting means to generate an override signal for reconfiguring said plurality of steering means in response to detection of said embedded tone signal;

first steering means for receiving said two channel stereo signals and for producing at a first channel an output signal derived therefrom and attenuated by a first of said steering voltages indicative of predominantly third signal information to remove a component desired at a second channel from said first channel output signal and attenuated by a combination of a second of said steering voltages indicative of predominantly fourth signal information and said override signal to remove a component desired at a third channel from said first channel output signal;

second steering means for receiving said two channel stereo signals and for producing at a fourth channel an output signal derived therefrom and attenuated by said first of said steering voltages indicative of predominantly third signal information to remove a component desired at said second channel from said fourth channel output signal and attenuated by a combination of said second of said steering voltages indicative of predominantly fourth signal information and said override signal to remove a component desired at a fifth channel from said fourth channel output signal;

third steering means for receiving said summed third signal and for producing at said second channel an output signal derived therefrom and attenuated by a combination of a third of said steering voltages indicative of predominantly first and second signal broadband information and said override signal;

fourth steering means for receiving said summed third signal and for producing at a sixth channel an output signal derived therefrom and attenuated by a combination of said third of said steering voltages indicative of predominantly first and second signal broadband information and said override signal; and fifth steering means for receiving said differenced fourth signal and for producing at said third channel an output signal containing a combination of high frequency band second signal and low frequency band first signal information and at said fifth channel an output signal containing a combination of high frequency band first signal and low frequency band second signal information selectively attenuated in response to a switching means operated in response to said override signal by said third steering signal, said third channel output signal being further attenuated by a fourth of said steering voltages indicative of predominantly second signal high frequency band information and by a fifth of said steering voltages indicative of predominantly second signal low frequency band information and said fifth channel output signal being further attenuated by a sixth of said steering voltages indicative of predominantly first signal high frequency band information and by a seventh of said steering voltages indicative of predominantly first signal low frequency band information.

* * * * *